US005269045A

United States Patent [19]

DeSerio et al.

[11] Patent Number: 5,269,045

[45] Date of Patent: Dec. 14, 1993

[54] ERGONOMICALLY ADJUSTABLE TOOL HANDLE

[75] Inventors: Kenneth R. DeSerio, Owego, N.Y.; Scott C. Thompson; Kenneth J. Dubuque, both of Athens, Pa.; Paul Urda, South Waverly, Pa.

[73] Assignee: Ingersoll-Rand Company, Woodcliff Lake, N.J.

[21] Appl. No.: 649,757

[22] Filed: Feb. 1, 1991

[51] Int. Cl.[5] ..... B25D 17/04; B25G 3/00; B25G 1/00

[52] U.S. Cl. ..... 16/114 R; 16/DIG. 12; 81/177.8; 81/489; 408/241 R

[58] Field of Search ..... 16/110 R, 114 R, 116 R, 16/DIG. 12, 111 R; 30/286, 514, 517, 518; 81/177.8, 177.9, 177.7, 177.85, 177.75, 489; 403/82, 84, 103, 104, 162, 163; 74/548, 543, 525; 173/170, 162.1, 162.2, 171; 408/241 R; 51/170 R, 170 PT

[56] References Cited

U.S. PATENT DOCUMENTS

| | | | |
|---|---|---|---|
| 1,539,068 | 5/1925 | Brockett | 173/170 |
| 2,513,271 | 7/1950 | Bluemink et al. | 173/170 |
| 2,976,436 | 3/1961 | Anton | 173/170 |
| 3,341,235 | 9/1967 | Mattson et al. | 16/114 R |
| 3,995,650 | 12/1976 | Divito | 16/121 |
| 4,136,579 | 1/1979 | Robinson et al. | 408/241 R |
| 4,197,764 | 4/1980 | Auernhammer | 16/114 R |
| 4,225,104 | 9/1980 | Larson | 16/114 R |
| 4,359,822 | 11/1982 | Kolodziejczyk | 173/170 |
| 4,368,556 | 1/1983 | Wanner et al. | 16/111 R |
| 4,522,270 | 6/1985 | Kishi | 173/170 |
| 4,643,263 | 2/1987 | Karden | 173/170 |
| 4,785,540 | 11/1988 | Arvidsson | 30/520 |
| 4,912,349 | 3/1990 | Chang | 173/170 |
| 5,065,476 | 11/1991 | Dohse | 16/110 R |

FOREIGN PATENT DOCUMENTS

| | | | |
|---|---|---|---|
| 402843 | 9/1924 | Fed. Rep. of Germany | 81/177.8 |
| 649733 | 6/1985 | Switzerland | 16/114 R |

OTHER PUBLICATIONS

UK Patent Application No. 2,124,536A, pub. Feb. 22, 1984; Inventor: Klaus Noss et al.; 3 sht. Dwgs & 4 pp. of spec.

E.P.A. #0,032,966, pub. date: Aug. 5, 1981; Inventor: Peter P. Pioch.

*Primary Examiner*—David Jones
*Assistant Examiner*—Donald M. Gurley
*Attorney, Agent, or Firm*—Robert F. Palermo

[57] ABSTRACT

An ergonomically adjustable handle for attachment to the body of a tool has a handle member with first and second ends with an axis between. Provision for attaching the first end of the handle to the tool body allows rotation of the handle about the axis through the attachment point. A pivot point is located on the axis of the handle member near the first end and permits deflection of the second end of the handle with respect to the first end. In addition, an outer layer portion of the handle member near the second end may be rotated about its axis to provide a comfortable position for the ellipsoidal cross section of the handle. Finally, clamping provisions at the articulation point and the two rotation mechanisms secure the handle in the desired position.

14 Claims, 3 Drawing Sheets

ERGONOMICALLY ADJUSTABLE TOOL HANDLE

BACKGROUND OF THE INVENTION

This invention relates generally to handles for power tools and more particularly to ergonomically adjustable tool dead handles which provide for operator comfort and convenience in a wide range of operating positions.

Use of handheld power tools may require holding the tools in a variety of positions in order to cut, rind, drill, fasten, or perform other operations on a workpiece. Depending on the size or nature of the tool, prolonged out of position operation may lead to serious discomfort and fatigue for the operator. In addition, the nature of some operations involves a possibility of tool jamming, kickback, or other irregularities which may unexpectedly transmit shock loads to the operator's arms.

Usually, if appropriate, power tools are equipped with auxiliary dead handles in addition to the operating trigger grip handle. Some dead handles are permanently fixed to the tool body and cannot be moved. Some other handles, however, may be attached at two or more locations on the tool body in order to optimize the operator's hand locations. Generally, the handles are provided as cylinders, tapered cylinders, or bulbous knobs, and, by permitting the use of two hands in manipulating the tool, improve efficiency by reducing operator fatigue and discomfort.

The dead handles described above are fixed in their angular relationship with the tool body. This, coupled with the circular cross sections of the handles which tend to transmit more concentrated physical shock and vibration to the operator's hands and fingers, often forces the operator to maintain his hands and arms in an uncomfortable position which can cause excessive fatigue and a rapid deterioration of accuracy and efficiency.

The foregoing illustrates limitations known to exist in present devices and methods. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing an ergonomically adjustable tool handle having first and second end segments; an elongate axis therebetween; a pivotable joint at which the two segments are connected, and which provides for clamping the end segments at a desired degree of pivotal deflection; and a mechanism for attaching the first end segment to the tool.

The foregoing and other aspects will become apparent from the following detailed description of the invention when considered in conjunction with the accompanying drawing figures.

DETAILED DESCRIPTION

Figure 1:
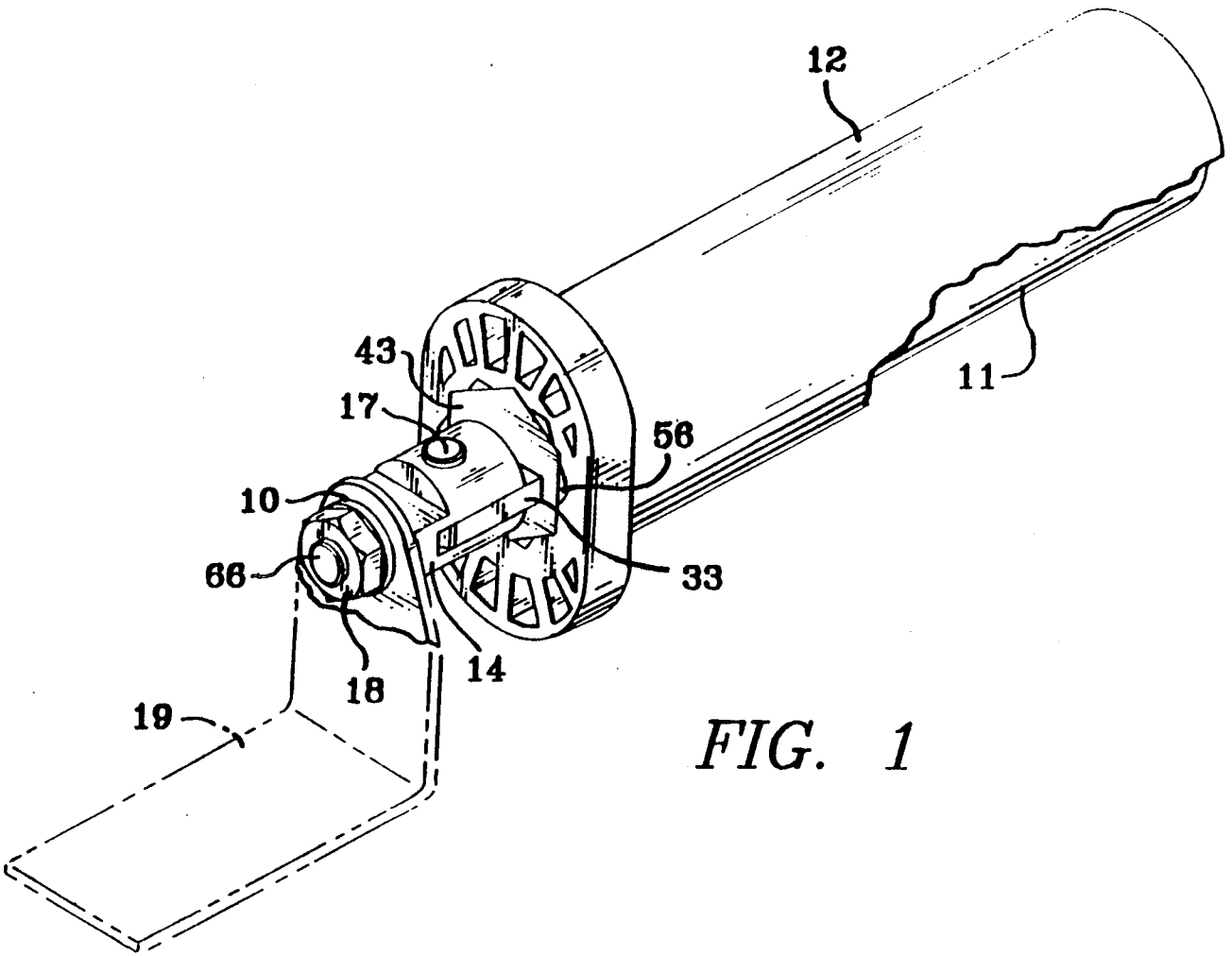
FIG. 1 is a partially cutaway schematic isometric view of the ergonomically adjustable handle.
Figure 2:
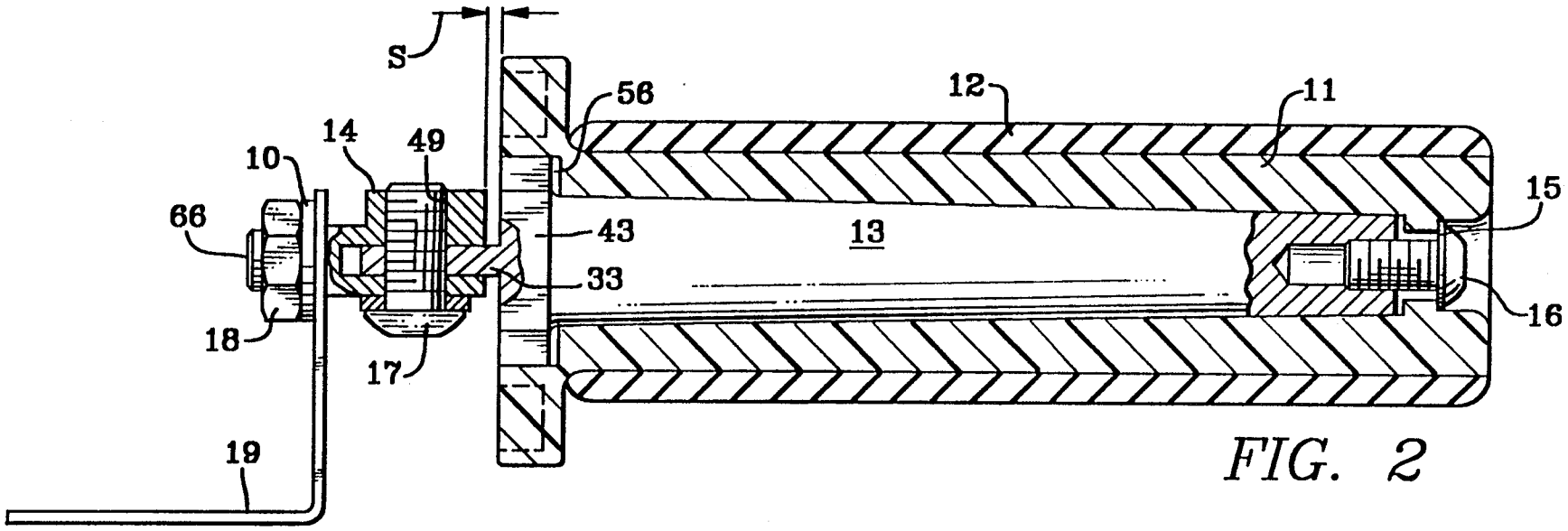
FIG. 2 is a partially sectional elevation view of the handle of FIG. 1.

FIG. 1 shows a partially cutaway schematic isometric view of the handle of the present invention. FIG. 2 shows the same handle in a partially sectional elevation view. Referring to FIGS. 1 and 2, a mounting bracket 19 is shown which is attached to the tool housing and is only indicated for reference purposes. A female clevis 14 is secured by clevis stud 66 to mounting bracket 19 with a nut 18 and lockwasher 10 fastened to the stud which projects from the clevis 14. An arbor blade 3 is engaged with clevis 14 and is clamped therein by capscrew 17 inserted in clamp pivot bore 49. Arbor blade 33 is integral with a hexagonal arbor lock 43 which is also integral with a tapered cylindrical handle arbor 13. For purposes of this description, the end of the handle attached to the mounting bracket will be designated "first end", and the opposite or distal end will be designated "second end". A grip handle 11 which has a taper to mate with the tapered handle arbor 13 is fitted on the arbor and is secured in place by a washer 15 and capscrew 16 at the second end. The first end of grip handle 11 is flared and has a twelve point grip handle socket 56 in which arbor lock 43 is indexably gripped to prevent relative rotation between tapered arbor 13 and grip handle 11. A resilient foam rubber or polymeric grip 12 overlays the grip handle 11 from the second end to the flare at the first end.

Figure 2A:
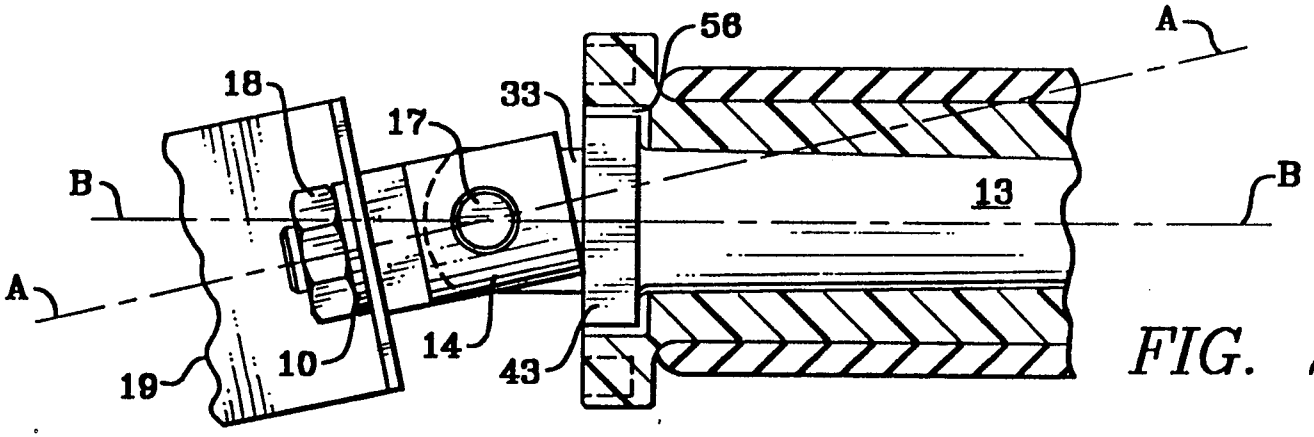
FIG. 2A is a partially-sectional schematic plan view of the handle of FIG. 2.

FIG. 2A is a partially-sectional schematic plan view. A space S between arbor lock 43 and clevis 14 is shown in FIG. 2. In FIG. 2A articulation about capscrew 17, in pivot bore 49, to about 17 degrees to either side is allowed before the articulated motion of clevis 14 brings its edge into contact with arbor lock 43, thereby limiting further articulation.

Figure 3:
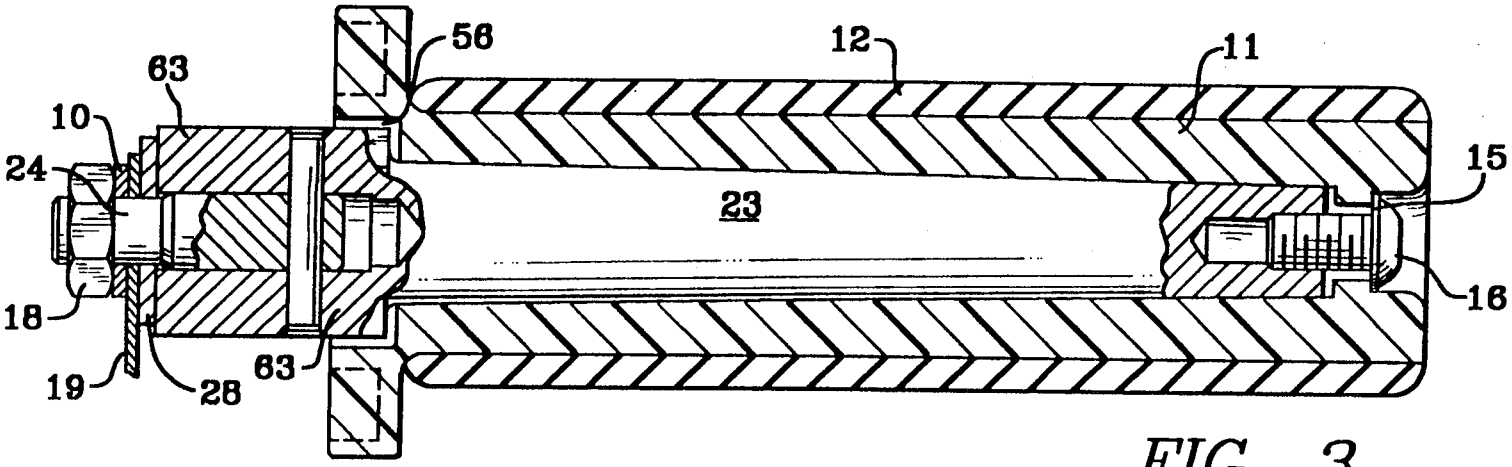
FIG. 3 is a partially sectional elevation view of a alternative embodiment of the handle.
Figure 4:
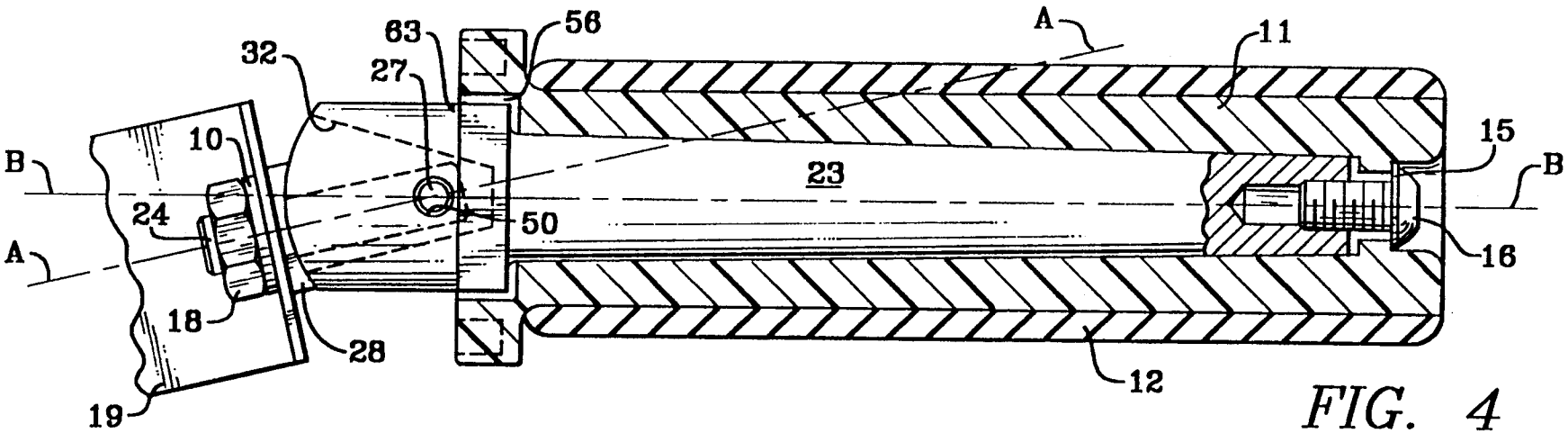
FIG. 4 is a partially sectional top view of the handle of FIG. 3 which illustrates operation of some features of both embodiments of the invention.

FIG. 3 shows a partially sectional elevation view of a second embodiment of the ergonomically adjustable tool handle, and FIG. 4 shows a partially sectional top view of the handle. All features in these figures indicated with the same numbers are identical to those indicated in FIGS. 1 and 2. In the embodiment of FIGS. 3 and 4, arbor lock 63 projects from the first end of tapered arbor 23 well beyond the twelve point grip handle socket 56. A pivot bore 50 is provided in the projecting portion of the arbor lock to secure an anchor bolt 24 to arbor lock 63 using a roll pin 27 in pivot bore 50. A 34 degree sector slot 32 is provided within arbor lock 63 to permit grip handle 11, tapered arbor 23, and arbor lock 63 to pivot 17 degrees to either side of anchor bolt 24 about roll pin 27. Clamp washer 28 is interposed between mounting bracket 19 and arbor lock 63 to clamp the handle in position with respect to its rotation about the axis A—A of anchor bolt 24 and its pivot position about roll pin 27 when nut 18 is tightened on anchor bolt 24.

Operation of the handle is easily understood by considering FIGS. 1-4. Axes A—A and B—B, in FIG. 2*a* and FIG. 4, are common to both embodiments. The pivot point is clamp pivot bore 49 in FIGS. 1 and 2 and pivot bore 50 in FIGS. 3 and 4 and the axis of articulation is parallel to the bores 49, 50 and orthogonal to axis A—A and axis B—B. Both handle embodiments are capable of pivoting of about pivot bore 49,50 by an angle of 17 degrees to each side of axis A—A of anchor bolt 24,66. Also, when nut 18 is loosened, female clevis 14 or arbor lock 63, as applicable, are capable of 360 degree rotation about axis A—A of anchor bolt 24, 66. Of course since grip handle 11 is locked to arbor lock 63, 43, as the case may be, handle 11 and resilient grip 12 must rotate along with clevis 14 or arbor lock 63. Thus, the locus of positions into which the handle may be moved is defined by a cone having a 34 degree included angle and having its apex at the pivot point in the pivot bore 49,50. Finally, the ellipsoidal cross section of the foam grip and grip handle can be indexably rotated 360 degrees about axis B—B. This is accomplished by loosening cap screw 16, withdrawing grip handle 11 along with resilient grip 12 far enough to free the arbor lock 43,63 from the 12 point grip handle socket 56, and rotating the handle to the desired indexed position in increments of 30 degrees.

In summary, the ergonomically adjustable tool handle of the present invention, has continuous 360 degree freedom of rotation about axis A—A which extends along the axis of the clevis stud 66 or the anchor bolt 24 from the mounting bracket 19 to the pivot bore 49,50. The handle is clamped in the set position by tightening nut 18 on the stud 66 (FIG. 2) or anchor bolt 24 (FIG. 3). In addition, folding or pivoting the handle second end within a 34 degree included angle (17 degrees to each side of axis A—A) is permitted about the pivot bore 49,50. In the first embodiment, shown in FIGS. 1 and 2, the handle is clamped in its desired pivoted position using cap screw 17 which locks arbor blade 33 in clevis 14. In the second embodiment, illustrated in FIGS. 3 and 4, clamping at a desired pivoted position is accomplished by tightening nut 18 which draws the extended portion of arbor lock 63 against clamp washer 28 which is securely wedged between arbor lock 63 and mounting bracket 19 by lock washer 10 and nut 18 on anchor bolt 24. The ellipsoidal grip handle 11 and resilient grip 12 are rotatable together in 30 degree increments about axis B—B which coincides with the axis of tapered arbor 13,23. When nested in handle socket 56, arbor lock 43,63 positively secures the orientation of the ellipsoidal handle. Cap screw 16 holds the grip handle 11 in registration with the arbor lock. Note that pivoting of the handle second end about pivot bores 49, 50 and rotating about axis B—B occurs about axes that are orthogonal to one another. The 360° rotation ability about axis A—A is also orthogonal to pivot bores 49, 50.

The invention has been described in two embodiments, the choice of which is determined by considerations of size, strength, cost, and manufacturability. Either embodiment, when properly installed and adjusted, provides an ergonomically correct dead handle which provides a high degree of operator comfort, convenience, and efficiency.

Having described the invention, what is claimed is:

1. An ergonomically adjustable auxiliary tool handle comprising:

an elongate handle member having a first end segment (14,24), an elongate second end segment (13,23) and a joint (49-17, 50-27) at which the two end segments are pivotally connected about a first axis, said joint having releasable clamping means for releasably clamping (17, 24-10-18-28) said end segments at a desired pivoted angle about said first axis; and means for attaching (18-24, 18-66) the first end segment (14,24) to a mounting bracket (19) on a tool, said means for attaching providing rotatability of the first end segment about an axis substantially perpendicular to said first axis and extending longitudinally through said first end segment from said mounting bracket to said joint at which the two end segments are pivotally connected.

2. The auxiliary tool handle of claim 1, further comprising:

an ellipsoidal outer layer portion (11, 12) mounted on said elongate second end segment (13,23), said ellipsoidal outer layer portion having means for indexably rotating about the axis of said elongate second end segment.

3. The auxiliary tool handle of claim 2, wherein the ellipsoidal outer layer portion comprises an ellipsoidal grip handle covered by a resilient grip, said grip handle being indexably rotatably mounted on a handle arbor.

4. The auxiliary tool handle of claim 2, further comprising:

means for clamping said ellipsoidal outer layer portion at a desired indexed position of rotation upon said second end segment.

5. The auxiliary tool handle of claim 4, wherein the means for clamping said ellipsoidal outer layer portion comprises a threaded fastener which forces a grip handle having a tapered cavity onto a congruently tapered arbor.

6. An ergonomically adjustable auxiliary tool handle comprising:

a handle member having first (14,24) and second (13,23) end portions, each end portion having a longitudinal axis extending through said end portion and also having means (49-17, 50-27) for pivotally joining said first and second end portions of the handle member together to form a handle assembly;

means on said first end portion for attaching (18-66, 18-24) the handle assembly to a mounting bracket (19) on a power tool, said means for attaching the handle assembly providing said handle assembly with 360 degree rotation capability relative to said mounting bracket about an axis (A—A) extending longitudinally through said means for attaching and said means for pivotally joining; and means for securing (18-10-66, 18-10-28-24) the handle assembly in a desired position of rotation.

7. The auxiliary tool handle of claim 6, further comprising:

an ellipsoidal outer layer portion mounted on said second end portion;

means permitting rotation of said ellipsoidal outer layer (11) of the second end portion of the handle member about the longitudinal axis (B—B) of said second end portion to provide desired orientation of major and minor transverse axes of said ellipsoidal outer layer.

8. The auxiliary tool handle of claim 7, further comprising:

means for clamping said ellipsoidal outer layer in a desired position of rotation.

9. The auxiliary tool handle of claim 6, further comprising:

means for fixing a pivot angle between said first end portion and said second end portion.

10. In a power tool of the type having a live trigger handle and at least one site (19) for attachment of an auxiliary handle, the improvement, in combination with said power tool, comprising:

an auxiliary handle member having first and second end portions, each end portion having an axis extending longitudinally through said end portion to a pivotable joint between said first and second end portions, said pivotable joint (17-49, 27-50) permitting deflection of the second end portion of said handle member with respect to said first end portion;

means for securing (17, 18-24-28) the handle end portions in a desired relatively pivoted position; and means attaching (18-66, 18-24) the first end portion of the auxiliary handle member to said attachment site (19), said means for attaching providing rotatability of the first end portion about its longitudinal axis.

11. The auxiliary handle member of claim 10, wherein the means for attaching the first end portion comprises a stud (66,24) and fastener (18) which, when said fastener is loosened, permits rotation of said auxiliary handle member about an axis A—A extending longitudinally through said stud (66,24) and through said pivotable joint.

12. The auxiliary handle member of claim 11, wherein the stud (66, 24) and fastener (18) can be tightened to clamp the auxiliary handle member in a desired position of rotation relative to said attachment site.

13. The auxiliary handle member of claim 10, further comprising:

means for rotating an ellipsoidal outer layer portion of the second end portion of said auxiliary handle member about an axis between the pivotable joint and a free end of the second end portion.

14. The auxiliary handle member of claim 13, further comprising:

means for clamping said ellipsoidal outer layer portion of said second end portion in a desired indexed position of rotation.

* * * * *